US011434061B2

(12) United States Patent
Lidster et al.

(10) Patent No.: US 11,434,061 B2
(45) Date of Patent: Sep. 6, 2022

(54) LABEL FOR MODIFIED ATMOSPHERE PACKAGING

(71) Applicant: IFOOD SYSTEMS CORPORATION, Summerland (CA)

(72) Inventors: Perry Lidster, Summerland (CA); Andrew Jared David Lidster, West Kelowna (CA)

(73) Assignee: Verséa Holdings Inc., Tampa, FL (US)

( * ) Notice: Subject to any disclaimer, the term of this patent is extended or adjusted under 35 U.S.C. 154(b) by 0 days.

(21) Appl. No.: 15/302,446

(22) PCT Filed: Apr. 8, 2015

(86) PCT No.: PCT/CA2015/050282

§ 371 (c)(1),
(2) Date: Oct. 6, 2016

(87) PCT Pub. No.: WO2015/154182

PCT Pub. Date: Oct. 15, 2015

(65) Prior Publication Data

US 2017/0021991 A1 Jan. 26, 2017

Related U.S. Application Data

(60) Provisional application No. 61/977,126, filed on Apr. 9, 2014.

(51) Int. Cl.
*B65D 81/28* (2006.01)
*B65D 81/20* (2006.01)
(Continued)

(52) U.S. Cl.
CPC ..... *B65D 81/28* (2013.01); *B65D 25/205* (2013.01); *B65D 81/2076* (2013.01); *B65D 85/345* (2013.01); *B65D 85/505* (2013.01)

(58) Field of Classification Search
CPC .... B65D 81/28; B65D 85/505; B65D 25/205; B65D 81/2076; B65D 85/345; B65D 85/50
(Continued)

(56) References Cited

U.S. PATENT DOCUMENTS 3,507,667 A * 4/1970 Michel ..... B65D 25/54 426/419
3,944,127 A * 3/1976 Bruke ..... B65D 77/062 206/205
(Continued)

FOREIGN PATENT DOCUMENTS

CA 1295972 C 2/1992
CA 2483026 A1 10/2003
(Continued)

*Primary Examiner* — J. Gregory Pickett
*Assistant Examiner* — Jenine Pagan
(74) *Attorney, Agent, or Firm* — Kilpatrick Townsend & Stockton LLP

(57) ABSTRACT

Maintenance of conditions optimal to perishable materials within a package during shipment will prolong the lifetime of the goods for shipment. The present invention provides a system for mitigating spoilage of perishable materials. The system comprises a container defining a compartment for storage of perishable materials, the container further defining an opening for providing communication between the compartment and an outside environment. A film cooperates with the container to seal the opening of the container and control flow of gas and water vapor transfer between the compartment and the outside environment.

15 Claims, 9 Drawing Sheets

(51) Int. Cl.
*B65D 85/34* (2006.01)
*B65D 25/20* (2006.01)
*B65D 85/50* (2006.01)

(58) Field of Classification Search
USPC ..... 206/205, 213.1, 524.1, 524.4, 524.6; 426/132, 133, 324, 326, 418, 419
See application file for complete search history.

(56) References Cited

U.S. PATENT DOCUMENTS 4,769,262 A * 9/1988 Ferrar ..... B65D 25/14 206/484.1
4,830,863 A * 5/1989 Jones ..... B65D 81/2076 426/118
5,045,331 A 9/1991 Antoon, Jr.
5,209,972 A * 5/1993 Super ..... B32B 27/08 428/349
5,698,249 A 12/1997 Hayashi et al.
5,938,012 A * 8/1999 Yeager ..... A24F 25/02 206/205
6,013,293 A * 1/2000 De Moor ..... B65D 81/2076 426/106
6,119,855 A * 9/2000 Yeager ..... A24F 25/02 206/205
6,190,710 B1 2/2001 Nir et al.
7,165,376 B2 * 1/2007 Kawashima ..... B65B 31/00 206/213.1
8,771,770 B1 * 7/2014 Crump ..... B65D 81/28 206/204
2003/0102080 A1 * 6/2003 Mallik ..... C09J 7/0246 156/325
2003/0215551 A1 * 11/2003 Garwood ..... B65D 81/2076 426/392
2004/0022676 A1 * 2/2004 Hamilton ..... A61L 2/20 422/37
2005/0106291 A1 * 5/2005 Kawashima ..... B65B 31/00 426/106
2005/0142310 A1 6/2005 Hatley
2005/0194387 A1 * 9/2005 Banks ..... A61L 2/26 220/371
2006/0110554 A1 * 5/2006 Bernig ..... B32B 27/08 428/35.2
2006/0147588 A1 * 7/2006 Garwood ..... A23L 3/3418 426/392
2006/0255055 A1 11/2006 Mulder
2007/0012696 A1 * 1/2007 Levie ..... B65D 81/266 220/8
2007/0092610 A1 * 4/2007 Mize ..... B65D 51/28 426/120
2008/0014383 A1 * 1/2008 Varriano-Marston ..... B65D 81/2076 428/34.1
2012/0219671 A1 * 8/2012 Siegel ..... B32B 27/08 426/132
2012/0228182 A1 * 9/2012 Ting ..... B65D 81/263 206/524.3
2014/0116900 A1 * 5/2014 Machado ..... B65D 81/28 206/205
2014/0326620 A1 * 11/2014 Mir ..... A01N 25/22 206/204
2017/0275078 A1 * 9/2017 Lidster ..... B65D 51/28

FOREIGN PATENT DOCUMENTS

DE 102007030191 1/2009
FR 2775962 9/1999
GB 2330818 5/1999
WO WO2008076075 6/2008
WO 2014104237 A1 7/2014

* cited by examiner

| Capran 2500 Day 1 | Capran 2500 35 days |
| --- | --- |
|  |  |
|  |  |

| Day 1 | Day 58 |
| --- | --- |
|  |  |
|  |  |

| MDPE/PE Day 1 | MDPE/PE Day 35 |
|---|---|
|  |  |
|  |  |

| MDPE/PE Day 1 | MDPE/PE 58 Days |
|---|---|
|  |  |
|  |  |

| 30EVHS1 Day 1 | 30EVHS1 Day 35 |
| --- | --- |
|  |  |
|  |  |

LABEL FOR MODIFIED ATMOSPHERE PACKAGING

CROSS-REFERENCE TO RELATED APPLICATIONS

This application is a national phase entry under 35 U.S.C. § 371 of PCT/CA2015/050282 filed on Apr. 8, 2015, which claims priority to U.S. Provisional Patent Application No. 61/977,126 filed on Apr. 9, 2014, the entirety of each of which is incorporated by this reference.

FIELD OF INVENTION

The present invention provides for a film for use on a modified atmosphere packaging container. More specifically, the film controls transfer of gas and water vapour between the interior of the container and the environment outside the container.

BACKGROUND OF INVENTION

Fruit, vegetables and cut-flowers are highly perishable agricultural commodities. Decay and growth of microorganisms including bacteria and fungi can lead to rapid quality deterioration and spoilage after harvest of agricultural commodities, as well as for other raw and processed food materials.

Maintenance of conditions optimal to the perishable goods within a package during shipment would prolong the lifetime of the goods for shipment. Environmental properties important to maintaining the quality of the perishable goods include oxygen ($O_2$) and carbon dioxide ($CO_2$) levels. As well, buildup of moisture in the vicinity of the perishable goods can lead to growth of microorganisms such as bacteria, fungus, and yeast. Sub-optimal conditions can lead to decay and spoilage of perishable goods.

SUMMARY OF INVENTION

The invention provides for a system for mitigating spoilage of perishable materials. The system comprises a container defining a compartment for storage of perishable materials, the container further defining an opening for providing communication between the compartment and an outside environment. The system further comprises a film that cooperates with the container to seal the opening of the container and control flow of gas and water vapor transfer between the compartment and outside environment.

In an aspect of the invention, the film has a water vapor transfer rate between 170 and 470 g $m^2$/day at 38° C. and 100% relative humidity.

In an aspect of the invention, the film has a water vapor transfer rate exceeding 200 g $m^2$/day at 38° C. and 100% relative humidity.

In a preferred embodiment, the film has a water vapor transfer rate between 171 and 202 g $m^2$/day at 38° C. and 100% relative humidity.

In an aspect, the film is permeable to water vapor to maintain a relative humidity between 85% and 100%.

In an aspect, the film has an $O_2$ transfer rate of 20-1245 $cm^3/m^2$/day atm at 25° C. and 0% relative humidity.

In an aspect, the film is formed to have a $O_2$ transfer rate of 20-36 $cm^3/m^2$/day atm at 25° C. and 0% relative humidity.

In an aspect, the film is formed to have a $CO_2$ permeability of 60-100 $cm^3/m^2$/day atm at 25° C. and 0% relative humidity.

In an aspect, the film has a thickness of 500-10,000 μm.

In an aspect, the film has a thickness of over 2,000 μm.

In an aspect, the film is a label and further comprises ink.

In an aspect, properties of the ink cooperate with the film to allow desired moisture and gas transfer properties to be maintained.

In an aspect, the ink is hydrophilic and non-metallic.

In an aspect, the container is formed from a rigid material formed to maintain shape when carrying perishable materials.

In an aspect, the container is comprised of a base defining the compartment for holding perishable materials, the base further defining an opening providing communication between the compartment and outside environment. The container further comprises a lid which cooperates with base forming a seal over the opening defined by the base, the lid defining a second opening. The film cooperates with the surface of the lid to seal the second opening and control gas flow and water vapor transfer between the compartment defined by the base and the lid, and the outside environment.

In an aspect, the lid comprises a recessed surface, wherein the second opening is positioned within the recessed surface, whereby the second opening is sealed upon application of the film.

In an aspect, the second opening is a perforated surface.

In an aspect, the recessed surface and the film define a second compartment formed to fit a spoilage inhibiting agent for mitigating spoilage of perishable items.

In an aspect, the film is comprised of the material Capran 2500.

In an aspect, the container is comprised of corrugated linerboard consisting of 40 gsm kraft/35 gsmPP/170 gsm kraft.

In an aspect, the lid is comprised of plastic. The plastic the lid is comprised of may be polyethylene terephthalate.

In a preferred embodiment of the system, the $CO_2$ and $O_2$ transmission rates of the sealed container are a maximum of 1000 $cm^3$/container/day and 1200 $cm^3$/container/day, respectively.

In another aspect, film is a flexible film.

BRIEF DESCRIPTION OF DRAWINGS

A detailed description of the preferred embodiments are provided herein below by way of example only and with reference to the following drawings, in which.

Figure 1:
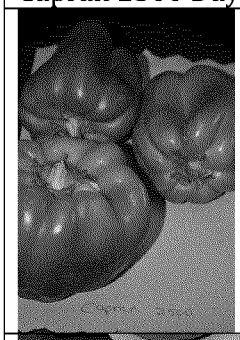
FIG. 1 provides images displaying quality of peppers during a test of an embodiment of the invention.
Figure 1:
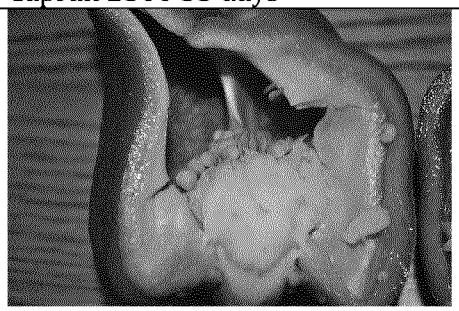
Figure 1:
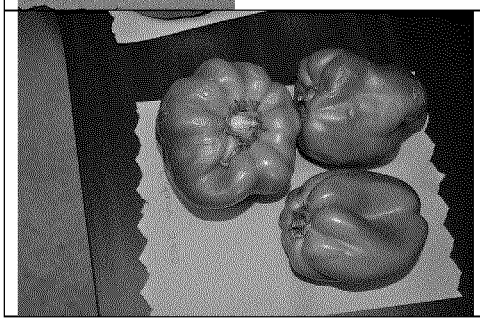
Figure 1:
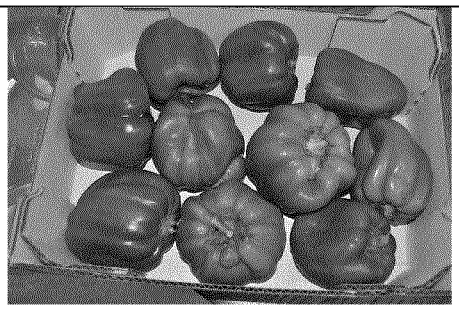
Figure 1:
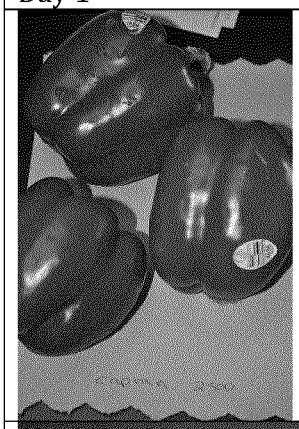
Figure 1:
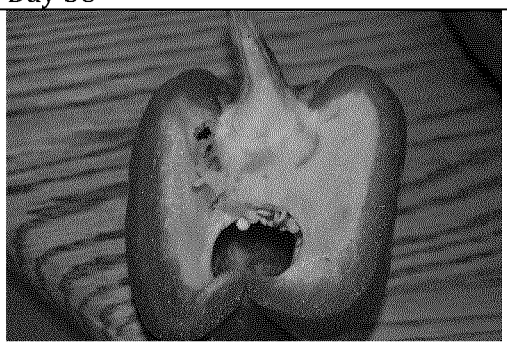
Figure 1:
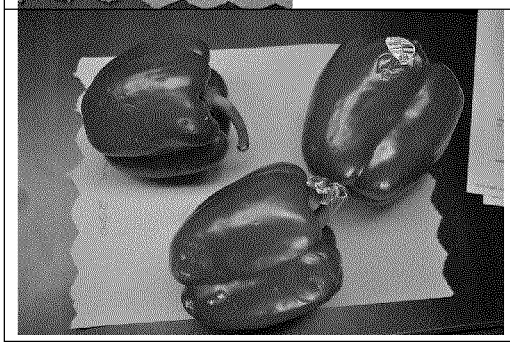
Figure 1:
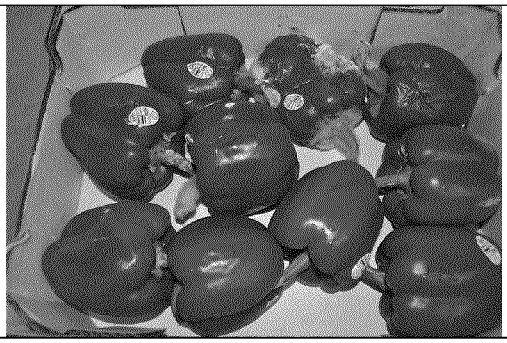
Figure 2:
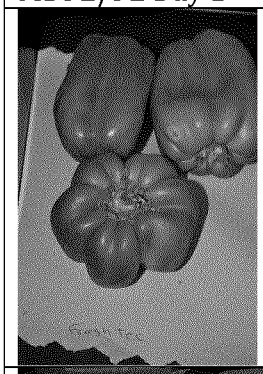
FIG. 2 provides images displaying quality of peppers during a test of an embodiment of the invention.
Figure 2:
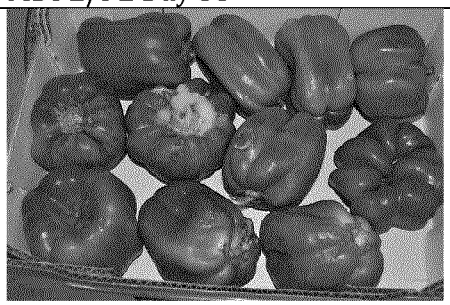
Figure 2:
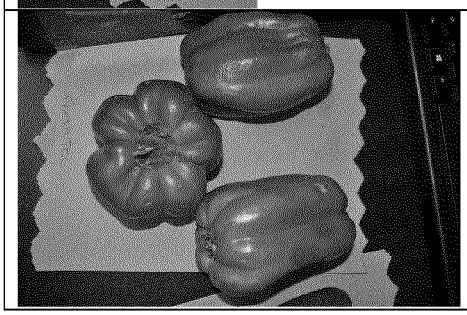
Figure 2:
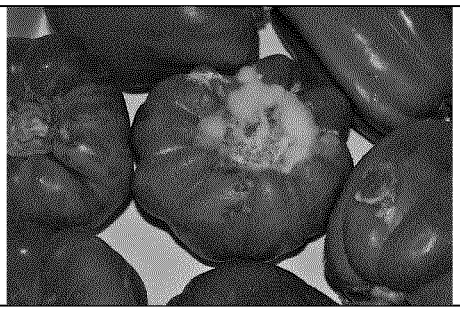
Figure 2:
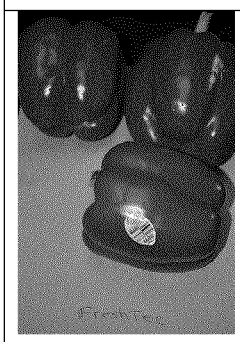
Figure 2:
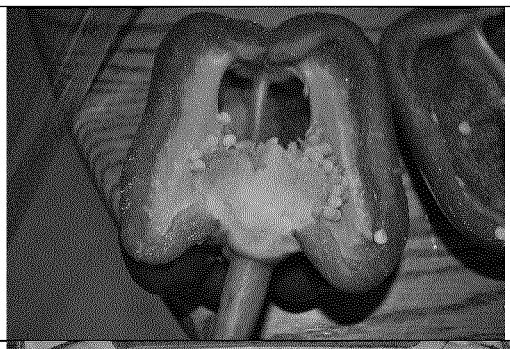
Figure 2:
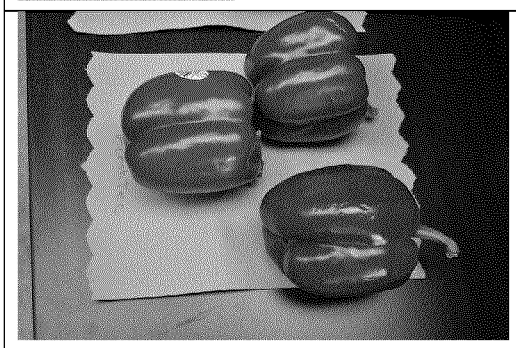
Figure 2:
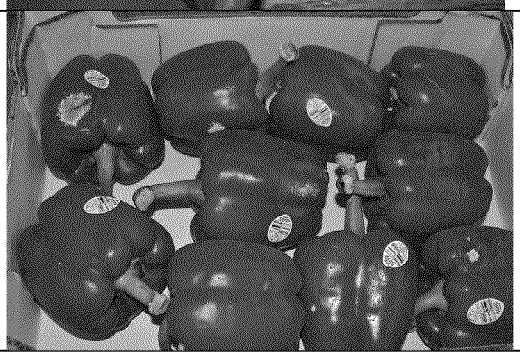
Figure 3:
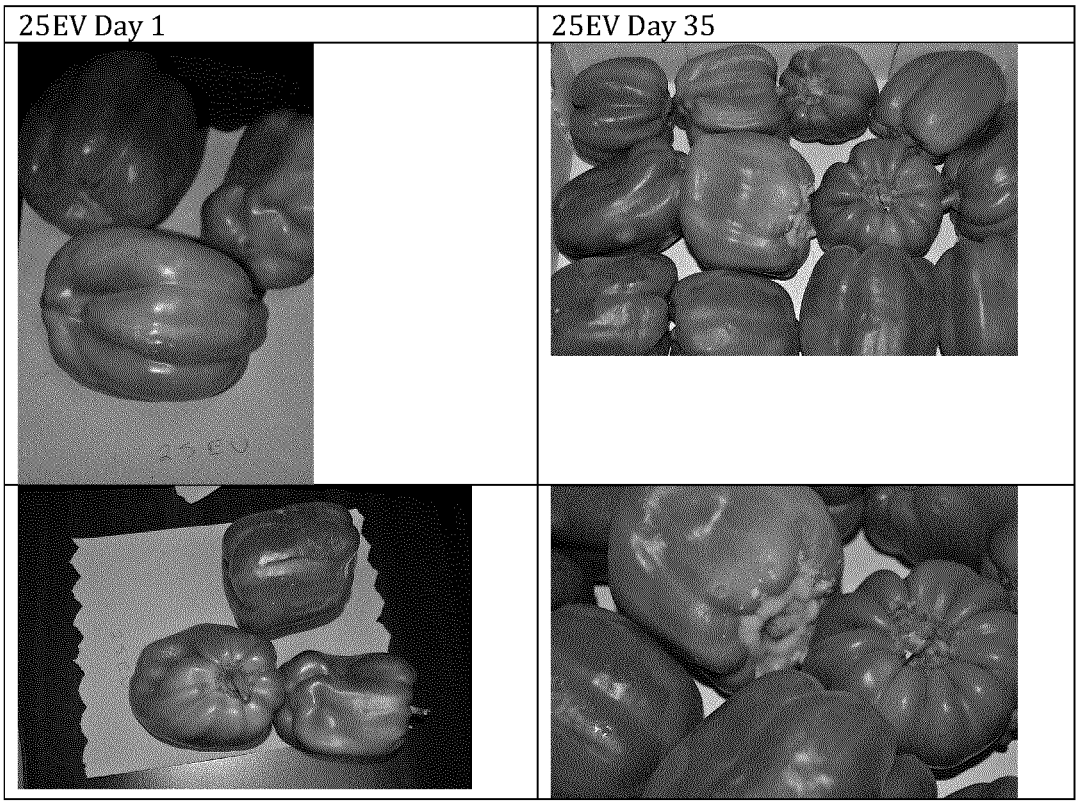
FIG. 3 provides images displaying quality of peppers during a test of an embodiment of the invention.
Figure 4:
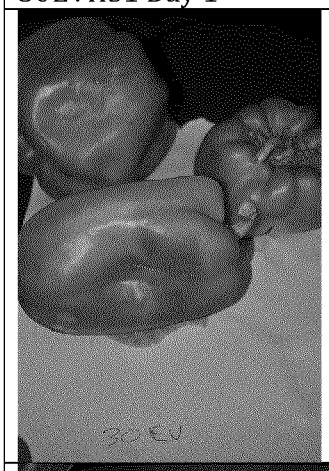
FIG. 4 provides images displaying quality of peppers during a test of an embodiment of the invention.
Figure 4:
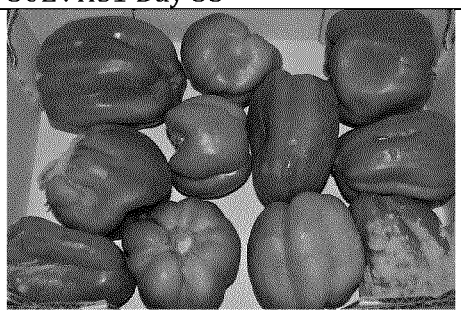
Figure 4:
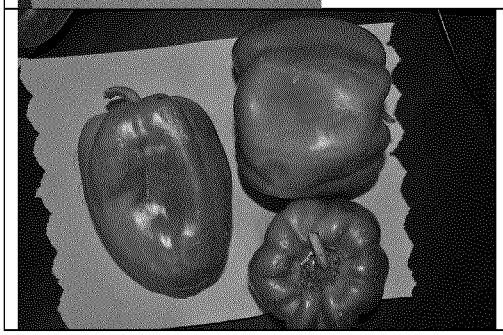
Figure 4:
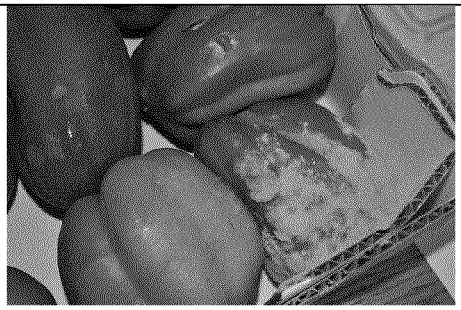
Figure 5:
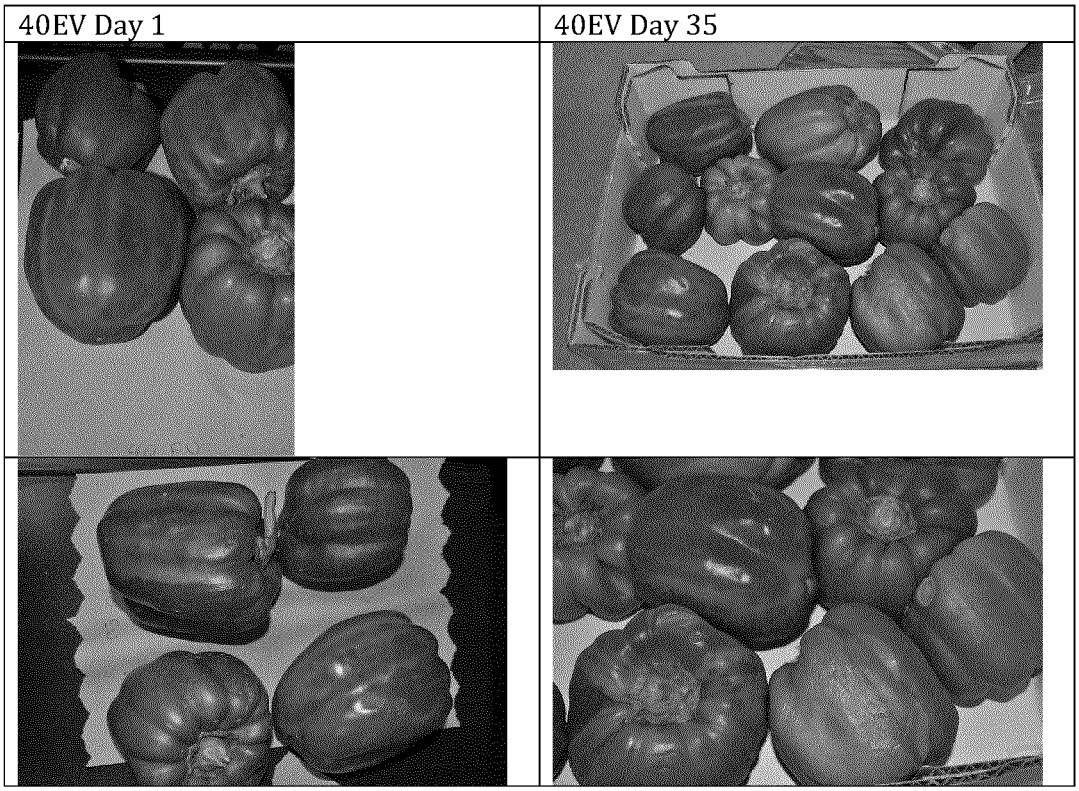
FIG. 5 provides images displaying quality of peppers during a test of an embodiment of the invention.
Figure 6:
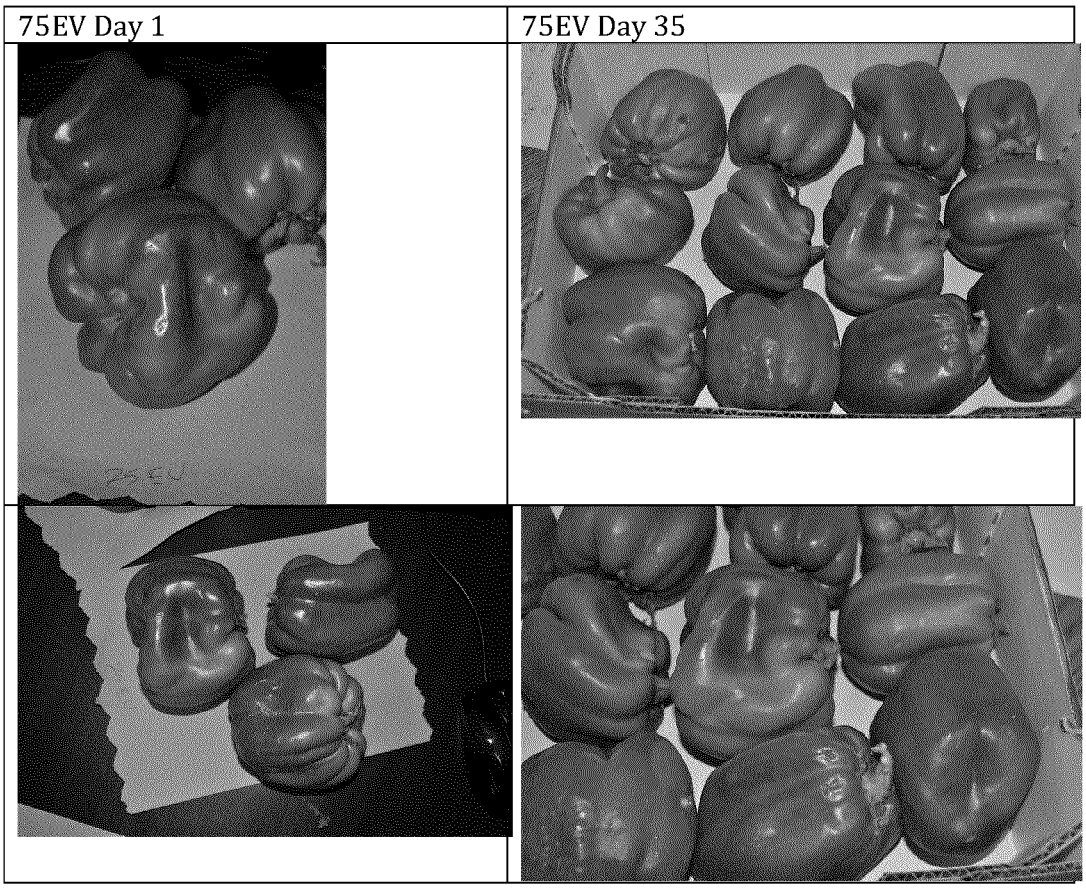
FIG. 6 provides images displaying quality of peppers during a test of an embodiment of the invention.
Figure 7:
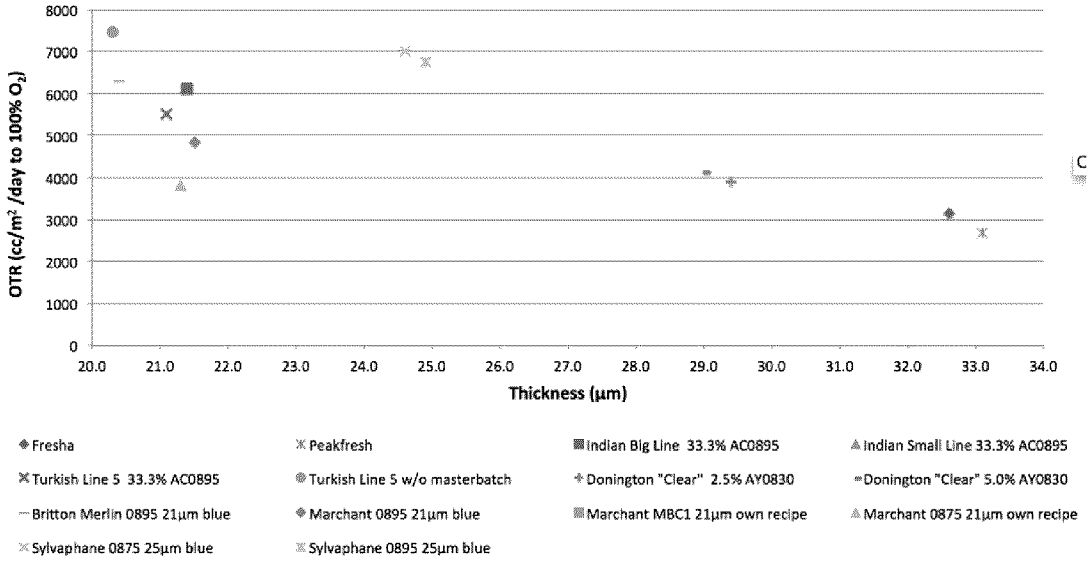
FIG. 7 provides graphs of properties of films that may be used in embodiments of the invention.
Figure 7:
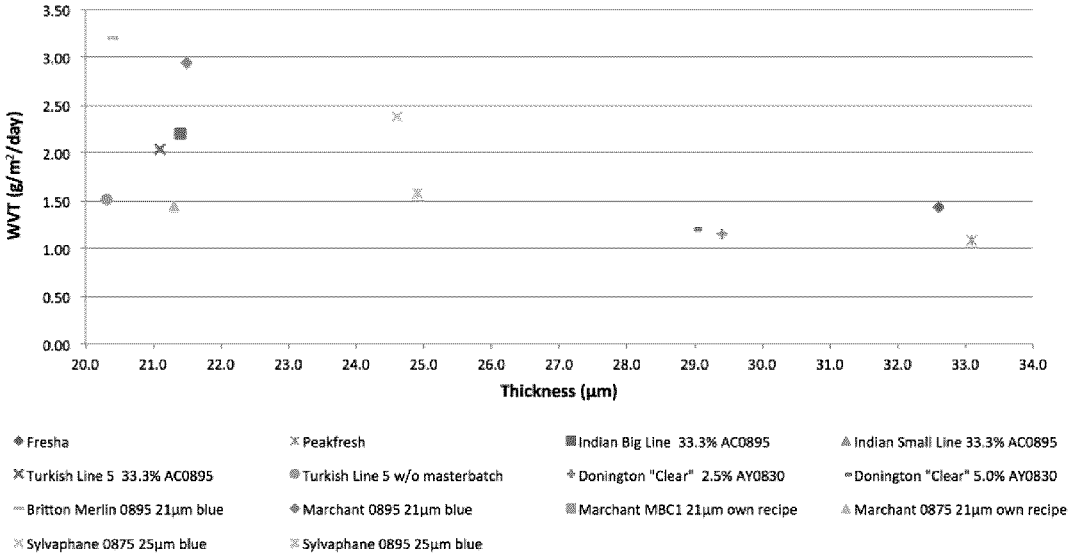

In the drawings, preferred embodiments of the invention are illustrated by way of example. It is to be expressly understood that the description and drawings are only for the purpose of illustration and as an aid to understanding, and are not intended as a definition of the limits of the invention.

DETAILED DESCRIPTION

It is appreciated that the many embodiments of the present invention can be utilized in a wide variety of applications and industries. The present invention can be utilized with the transportation, treatment, and storage of a plethora of items. Items include but are not limited to produce, cheeses, flowers, poultry, and other meats and seafoods, nuts, dehydrated foods, mail, parcels, medical tools and equipment, etc.

The invention provides for a system for mitigating spoilage of perishable materials, the system comprising a container defining a compartment for storage of perishable materials, the container further defining an opening for providing communication between the compartment and an outside environment. The system further comprises a film that cooperates with the container to seal the opening of the container and control gas flow and water vapor transfer between the compartment and the outside environment.

The outside environment is the area outside of the system. The outside environment may be the atmosphere within shipping containers, warehouses, distribution centres, or any other location the system may be placed. For example, it is not uncommon for perishable materials such as produce to be packed into the system in an agricultural field, shipped over long distances, and stored for periods of time at storage locations. All of these locations may comprise the outside environment at one time or another.

The permeability of material is typically defined as the water vapor transfer rate, moisture vapor transmission rate, or water vapor transmission rate. For greater certainty, water vapor transfer rate, moisture vapor transmission rate, and water vapor transmission rate have the same meaning. These are defined as the measure of the movement of water vapor through a material. The conditions under which the measurement is made affects the measurement. These conditions include temperature and humidity, which should be measured, controlled, and recorded with the result, when defining the water vapor transfer rate of a material.

In an embodiment, the film has a permeability to water vapor exceeding about 200 $g/m^2$/day at 38° C. and 100% relative humidity. Preferably, the permeability of the film provides for a relative humidity within the system of 85-90%.

In an embodiment, the water vapor transfer rate of the film is 170-470 $g/m^2$/day at 38° C. and 100% relative humidity.

In an embodiment, the water vapor transfer rate of the film is 171-202 $g/m^2$/day at 37.8° C. and 100% relative humidity.

In an embodiment, the film maintains an atmosphere within the system of 1-20% $O_2$ and 0.5-20% $CO_2$, and a relative humidity of 85-100% at −0.5 to 15° C.

In an embodiment of the invention, the film is a plastic material having a thickness of 500 to 10,000 μm. Preferably the film material has a thickness of 2,000 μm or greater.

Increasing thickness of the film is inversely proportional to the transfer rate of water vapour through the film. It is preferable that the film has a sufficient thickness to be handled and applied to the container using automated machinery, yet thin enough to maintain optimal water vapour transfer rates. It is also desirable to maintain optimal $CO_2$ and $O_2$ transfer rates in order to mitigate spoilage of perishable goods.

An embodiment of the film is formed from a material having a $CO_2$ transfer rate of approximately 50-100 $cm^3/m^2$/day at 0% relative humidity and 38° C.

In an embodiment, the film is formed to have an $O_2$ transfer rate of 20-36 $cm^3/m^2$/day at 0% relative humidity and 25° C. In another embodiment, the film is formed to have an $O_2$ transfer rate of 20-1245 $cm^3/m^2$/day at 25° C. and 0% relative humidity.

In an embodiment, the film is formed to have an $O_2$ transfer rate of 2500-7500 $cm^3/m^2$/day at 15° C. and 90% relative humidity.

The $CO_2$ and $O_2$ transmission rates of the sealed container should be a maximum of 1000 $cm^3$/container/day and 1200 $cm^3$/container/day, respectively, at a relative humidity of 85-100% at −0.5 to 15° C.

An embodiment of the film comprises a polyamide. The polyamide may comprise nylon-6 or nylon-66 or copolyamides such as nylon-6/66 or nylon-6/12. For example, the material may be manufactured from a polymeric material that comprises a blend of nylon-6 and nylon-66, nylon-6/66, or nylon 6/12 with other polymeric and/or non-polymeric components.

In an embodiment, the raw material the film is comprised of may be manipulated to tailor its permeability to water vapor, to either increase or decrease the water vapor permeability of the film. For example, blends of nylon-6 or nylon 6/66 with other raw materials may be processed to provide a film with a lower water vapor permeability or a higher water vapor permeability than a film processed with nylon-6 alone.

Alternatively, the film material may be manipulated by steam treatment or other processes to increase its water vapor permeability.

Preferably, an embodiment of the composition of the film material includes a polyamide such as nylon-6 or nylon-66, commercially available from Allied Signal as Capron® 3090FN, or copolyamides such as nylon-6/66, commercially available from Allied Signal as Capron® CA95YP, or nylon-6/12, commercially available from EMS as Grilon® CR8. The material may be manufactured from blends containing nylon-6, nylon-66, nylon-6/66, or nylon-6/12 with other polymeric and/or non-polymeric components. For such polyamides alone, oxygen ($O_2$) permeability is about 0.4-1.5 $cm^3$ $mm/m^2$ day atm and carbon dioxide ($CO_2$) permeability is about 1.8-3.0 $cm^3$ $mm/m^2$ day atm when measured at 23-25° C. and 0% relative humidity.

An embodiment of the film additionally comprises a blend of polyamides with other homopolymer polyamides. By blending a given polyamide with a second polyamide having a higher percentage of amide groups than the original polyamide, the water vapor permeability of the blend will usually be higher than that of the original polyamide. By blending a given polyamide with a second polyamide having a lower percentage of amide groups than the original polyamide, the water vapor permeability of the blend will usually be lower than that of the original polyamide. For example, nylon-6 may be blended with nylon-11 or nylon-12 to produce films having reduced water vapor permeability relative to that of nylon-6 alone and are characterized by minimal moisture condensation on the film surface when used in cooperation with a container to package produce.

An embodiment of the film comprises a blend of polyamides with copolymers containing amide groups. For example, blends of nylon-6/66 copolymer with nylon-6, in an amount ranging from 5-100% nylon-6/66 give increased water vapor permeability and gloss relative to nylon-6 alone. As a further example, the plastic packaging material may comprise nylon-6 blended with nylon-6I/6T, commercially available from Du Pont as SELAR® PA 3426, to produce films of 20 and 30 micron thickness. Ratios may be between 80-99% nylon-6 and 1-20% nylon-6I/6T. The resulting films have reduced water vapor permeability relative to nylon-6 alone and retain the ability to minimize condensation.

Another embodiment of the film material may comprise polyamides or other hydrogen bonding polymers blended with polyether-block-amides, such as Pebax® MX1205, commercially available from Elf Atochem, to increase water vapor permeability of the material relative to the polymers without polyether-block-amides.

Embodiments of the film can include varied thickness, water vapor transfer rate, gas transfer rate of $CO_2$ and/or $O_2$, and size and area covered by the film. For example, increased water vapor transmission can be achieved with films having a larger area.

Properties of the film are such that the water vapor transmission rate increases with temperature. This leads to removal of more moisture produced by produce or other perishable goods at higher temperatures.

In an embodiment, the film is comprised of CAPRAN® 2500, MDPE/PE, 75 EVHS1, 40 EV, 30 EVHS1, or 25EV material. Preferably, the film is comprised of CAPRAN® 2500.

CAPRAN® 2500 is a 1.0 mil (25 micron) biaxially oriented nylon 6 film. Properties of CAPRAN® 2500 are elaborated on in Table 2.

Figure 9:
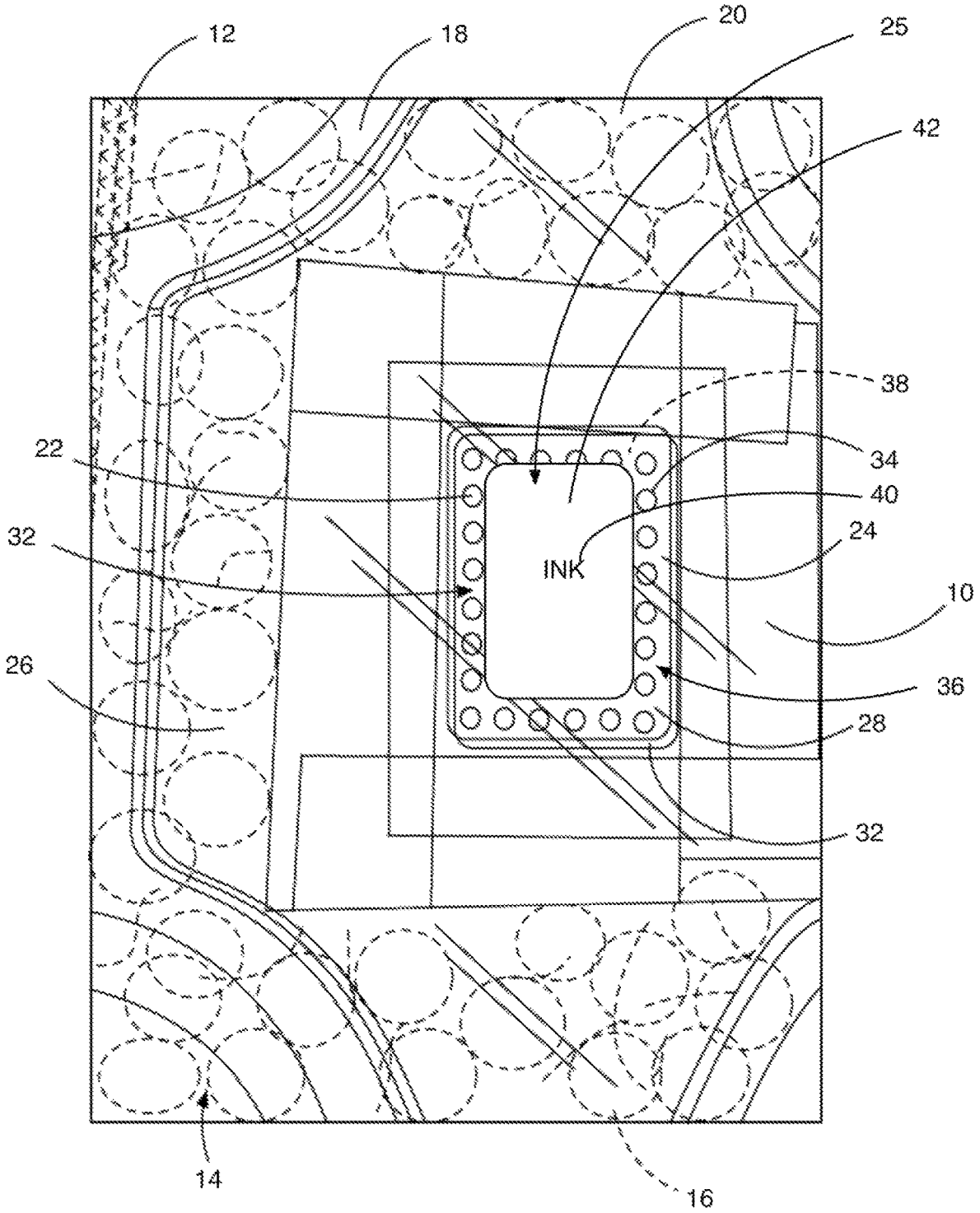
FIG. 9 provides a view of another embodiment of the invention.

As shown in FIG. 9, in label 25 comprises film 24 and ink 40. The ink 40 cooperates with the film 24 material to allow for maintenance of optimal transfer of water vapour to mitigate condensation in the container. The ink 40 may further cooperate with the film 24 to allow desired gas transfer properties of the film 24 to be maintained. In a preferred embodiment, the ink 40 is hydrophilic and capable of transmitting water vapour. The ink is preferably non-metallic as metallic inks have low water vapor transmission rates.

The label is functional in that it provides graphic and identifying information, while allowing water vapor to transmit.

Messaging provided on the label can be customized through application of ink in various designs which may include words, logos, brands, colors and pictures.

In an embodiment, the label further serves to seal in antimicrobial vapors held within the container in order to maintain antimicrobial activity within the compartment of the system. The purpose of maintaining antimicrobial activity within the compartment of the system is to mitigate growth of pathogens and microbials and thus mitigate spoilage of perishable goods such as produce within the system.

Figure 8:
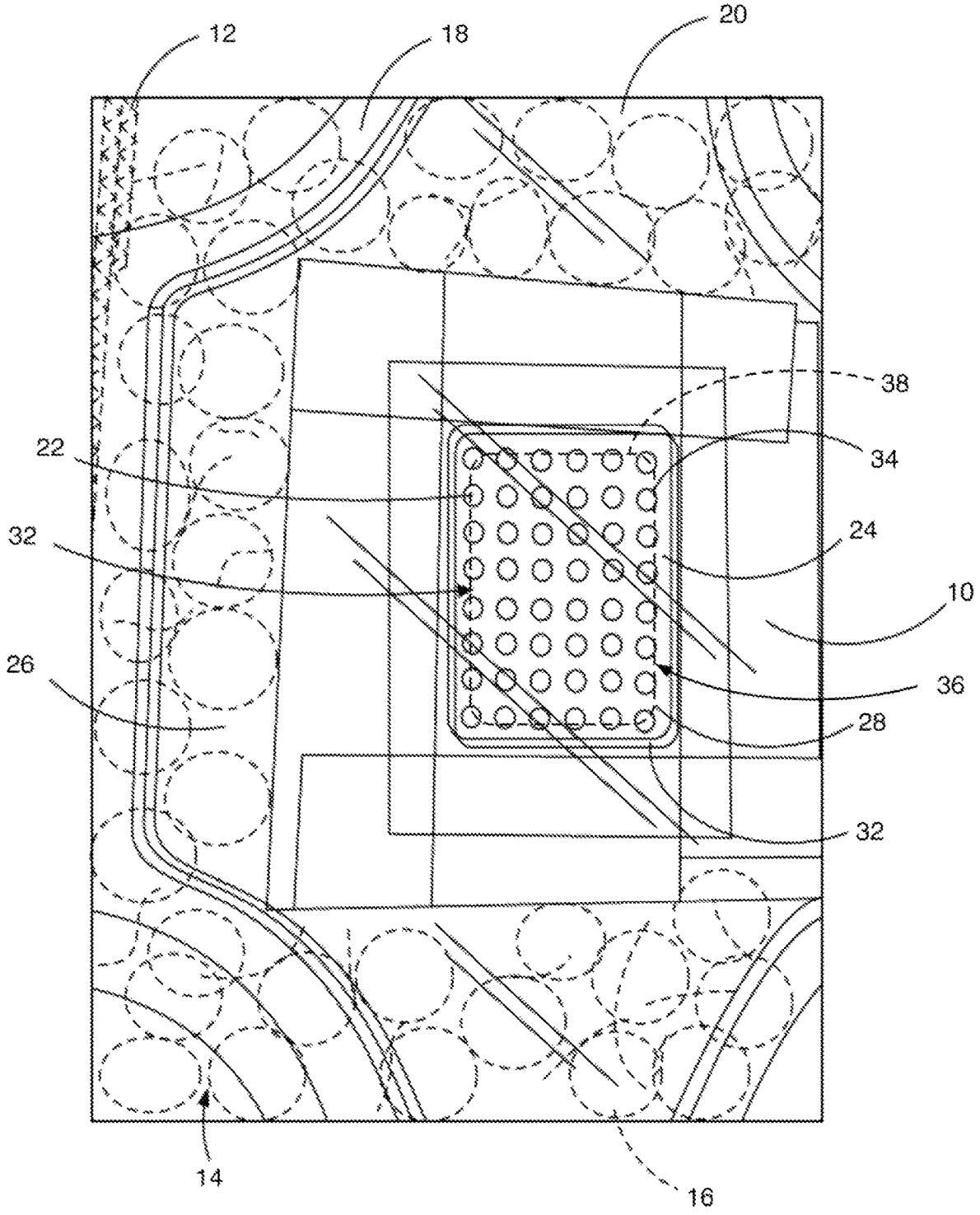
FIG. 8 provides a view of an embodiment of the invention.

As shown in FIG. 8, the system comprises a film cooperating with a container to seal the compartment defined by the container from the environment outside the container. The container may be comprised of a rigid material or a flexible material. Preferably, the container is comprised of a rigid material, as the rigid material protects the container contents to mitigate bruising of perishable goods in the compartment of the container when packages are stored in close vicinity to one another during packing, shipment, and storage. The film provides for a relatively higher permeability to water vapor and gas than the container, effectively controlling the rate of water vapor transfer and gas flow from inside the container to outside the container.

As shown in FIG. 8, the container 10 is comprised of a base 12 defining the compartment 14 for holding perishable materials 16, the base 12 further defining an opening 18 providing communication between the compartment 14 and the outside environment. The container 10 further comprises a lid 20 which cooperates with the container base 12 to form a seal over the opening 18. The lid defines a second opening 22. The film 24 cooperates with the surface 26 of the lid 20, allowing the film 24 to seal the second opening 22 and control flow of gas and water vapor transfer between the compartment 14 defined by the base 12 and lid 20, and the outside environment. The film 24 may be sealed to the lid 20 by an adhesive.

The lid 20 may further comprise a recessed surface 28 relative to a raised surface 26 of the rest of the lid 20, the second opening 22 defined by the recessed surface 28. The film 24 may be applied to the portion of the lid 20 raised relative to the recessed area to cover and seal the space 32 defined by the recessed surface 28 and walls 32 between the raised surface 26 and recessed surface 28. The walls 32 connecting the raised surface 26 and recessed surface 28 may be substantially perpendicular or they may be slanted relative to the surfaces 26 and 28.

As shown in FIG. 8, the second opening 22 is comprised of a plurality perforations 34 defined by the recessed surface 28. The recessed surface 28 and the film 24 adhered to the raised surface 26 may define a second compartment 36 formed to fit a sachet 38 containing contents suitable for mitigating spoilage of perishable items. Sachet 38 contents may comprise an oxidizing material or other means of mitigating growth of microorganisms in the compartment.

As shown in FIG. 8, any of the openings defined by the container or container lid may be comprised of a plurality of perforations defined by the container or container lid.

In an embodiment, the second opening 22 defined by the lid is 3" by 4" and the film 24 is sized as a 5"×4".

As shown in FIG. 9, The film 24 can be die cut on the printing line. Ink 40 can be applied as a silk screening process. A screening process could include application of a base coat of background 42 color such as white with the other colors applied subsequently in the silk screening process.

In an embodiment of the system, the container is formed from corrugated flat stock that has low carbon dioxide and oxygen transmission rates (1700-2000 $cm^3/m^2/d$ and 500-700 $cm^3/m^2/d$, respectively at a relative humidity of 85-100% at −0.5 to 15° C.) and is impervious to water vapor transmission. Preferably the oxygen transmission rate of the corrugated flat stock is 600 $cm^3/m^2/d$. To achieve the low rates of oxygen, carbon dioxide and water vapor transmission rates, a linerboard consisting of 40 gsm kraft/35 gsmPP/170 gsm kraft is corrugated on one or both sides of the fluting material. The carton design consists of raised corners with intermediate support provided by either the corrugate or the lid corner supports. In this embodiment, the system further comprises plastic lid of unique design that is form fitted to the box and sealed with a high barrier tape. The film is applied to the surface of the lid to seal the second opening.

An embodiment of the lid is comprised of a plastic material. The plastic material is preferably polyethylene terephthalate (PETE).

In an embodiment of the system, the label may be designed from the following materials:

TABLE 1

| Material Origin | Mean Grammage (g/m2: approx. microns) | Mean $O_2$ Barrier (15 degree C. 90% RH Oxtran 2/20). ($cm^3$/m2/day to 100% O2) | Mean Moisture Barrier (15 degrees C. 100% RH Permatran W3/33) (g/m2/day) |
|---|---|---|---|
| Fresha | 32.6 | 3120 | 1.43 |
| PeakFresh | 33.1 | 2668 | 1.09 |
| Indian Big Line (33.3% AC0895) | 21.4 | 6116 | 2.20 |
| Indian Small Line (33.3% AC0895) | 19.9 | 6751 | 2.25 |
| Turkish Line 5 (33.3% AC0895) | 21.1 | 5495 | 2.04 |
| Turkish Line 5 (without masterbatch) | 20.3 | 7475 | 1.52 |
| Donington "Clear" (2.5% AY0830) | 29.4 | 3903 | 1.16 |
| Donington "Clear" (5% AY0830) | 29.0 | 4130 | 1.20 |
| Britton Merlin 0895 21 um blue | 20.4 | 6314 | 3.20 |
| Marchant 0895 21 um blue | 21.5 | 4819 | 2.94 |
| Marchant MBC1 21 um own recipe | 18.5 | 6372 | 2.24 |

TABLE 1-continued

| Material Origin | Mean Grammage (g/m2: approx. microns) | Mean $O_2$ Barrier (15 degree C. 90% RH Oxtran 2/20). ($cm^3$/m2/day to 100% O2) | Mean Moisture Barrier (15 degrees C. 100% RH Permatran W3/33) (g/m2/day) |
|---|---|---|---|
| Marchant 0875 21 um own recipe | 21.3 | 3794 | 1.45 |
| Sylvaphane 0875 blue | 24.6 | 7020 | 2.39 |
| Sylvaphane 0895 blue | 24.9 | 6731 | 1.57 |
| Compost Ready 1294S 25 um | 31.7 = 25 μm | 341 | 42.5 |
| Compost Ready 1294SLE 25 um | 33.2 = 25 μm | 278 | 50.0 |

A perceived advantage of the system is that mass production of containers, or in some embodiments container bases and lids, can be economically achieved. This is followed by application of customized films having properties optimized to control water vapor and gas transfer rate of the system to mitigate spoilage of perishable goods. When the film is a label, the design of ink on the label may be customized. Application of customized films and labels to mass produced containers, container bases and lids to form a system for mitigating spoilage of perishable goods provides for economic efficiencies in production.

Example 1

Bell peppers were harvested and transported to a cooler within 4 hours of harvest. The peppers are cooled to 7° C. within 6 hours by pressure cooling. They are held in forced air cooling at 7° C. overnight (75-90% RH). Peppers are packed containers comprising a ½ Euro box (30 cm×40 cm×11 cm tall). The container was comprised of corrugated linerboard consisting of 40 gsm kraft/35 gsmPP/170 gsm kraft. The container has low oxygen and carbon dioxide transmission rates and are impervious to water vapor transmission. A polyethylene terephthalate lid having a 4" by 3" opening was form fitted to the box and sealed with a high barrier tape to the opening at the top of each container.

Films of 5" by 4" dimensions were adhered and sealed to the lid to cover the openings. Film adhered to the containers were selected from the a list of films consisting of FreshTec, Capran 2500, 75EVHS1, 40EV, 30EVHS1, 25EV. Each box is weighted and the weight was recorded on the box and in a record book.

The material properties of the 6 films tested are outlined in Table 2.

TABLE 2 typical properties at 23 C. - 50% RH unless otherwise noted

| Material | Gauge (microns) | Yield ($m^2$/kg) | Tensile Strength | Gloss | Haze | COF | WVTR ($g/m^2$/day) - 100% RH | $O^2$TR ($cc/m^2$/day) - 0% RH @38 C. |
|---|---|---|---|---|---|---|---|---|
| (MDPE/PE) | 2-3 mm | | | | | | 0.1 $cm^3/m^2$/day | 947 ± 32 at 24° C. |
| Capran 2500 | 25 (1 mil) | 34.1 | 235-290 MPa | 90-140 @ 20 C. | 2.3-3.4% | | 171-202 | 20-36 |
| 75 EVHS1 | 75 | 10.7 | 62 $N/mm^2$ | 75 @ 45 degrees | ≤2 | 0.5 | 170 | 458 @ 25 C. |
| 40EV | 40 | 20.0 | 62 $N/mm^2$ | 75 @ 45 degrees | ≤2 | 0.5 | 250 | 645 @ 25 C. |
| 30EVHS1 | 30 | 26.8 | 62 $N/mm^2$ | 75 @ 45 degrees | ≤2 | 0.5 | 350 | 965 @ 25 C. |
| 25EV | 25 | 32.1 | 62 $N/mm^2$ | 75 @ 45 degrees | ≤2 | 0.5 | 466 | 1245 @ 25 C. |

It should be further noted that the MDPE/PE film had an approximate $CO_2$ transmission rate of 2,732 $cm^3/m^2/day \pm 101$, and a $CO_2$ to $O_2$ transmission rate ratio of approximately 2.79 at 23° C. and 52% RH.

Each container and film combination holding peppers was stored at between 3 and 4° C., and observations on visible moisture and the state of the peppers were recorded over time.

Evaluations were performed on the peppers immediately upon removal from storage and after two days at 18° C. and 50% RH. Samples taken for evaluation of color maturity and firmness at harvest, day 0, day 14, day 21 and day 28+. Samples were evaluated for fruit condition, stem shrivel, fruit shrivel, moisture level, decay, flavor and texture based on a five point scale, as well as carbon dioxide levels and weight loss on a percentage basis.

Tests of each container label combination were performed in duplicate and results are shown in FIGS. 1-6 and in Table 3.

TABLE 3

Observations from pepper storage trials.

| Date | Process/ Temp | Label | Weight | Observations | Rating or CO2 Reading |
|---|---|---|---|---|---|
| May 30, 2013 | Cooler Temp 3° C. | MDPE/PE | 5 lbs 5.65 oz | Packing Day, Day 1 Internal temperatures of peppers in all containers were measured at 9° C. | |
| | | Capran 2500 | 5 lbs 5.20 oz | | |
| | | 75 EVHS1 | 5 lbs 5.20 oz | | |
| | | 40EV | 5 lbs 5.85 oz | | |
| | | 30EVHS1 | 5 lbs 5.90 oz | | |
| | | 25EV | 5 lbs 6.10 oz | | |
| May 31, 2013 | Cooler Temp 4° C. | MDPE/PE | | Moisture droplets on lid | |
| | | Capran 2500 | | No Visible moisture | |
| | | 75 EVHS1 | | No Visible moisture | |
| | | 40EV | | Small amount of moisture on label | |
| | | 30EVHS1 | | No Visible moisture | |
| | | 25EV | | No Visible moisture | |
| Jun. 3, 2013 | Cooler Temp 3° C. | MDPE/PE | | Moisture present on lid and peppers | |
| | | Capran 2500 | | No Visible moisture | |
| | | 75 EVHS1 | | No Visible moisture | |
| | | 40EV | | No Visible moisture | |
| | | 30EVHS1 | | No Visible moisture | |
| | | 25EV | | Visible moisture on lid and peppers could be due to placement in fridge at back of box | |
| Jun. 5, 2013 | Cooler Temp 4° C. | MDPE/PE | | Water dripping off Lid | 6 |
| | | Capran 2500 | | No Visible moisture | 1 |
| | | 75 EVHS1 | | Moisture starting to form on lid | 5 |
| | | 40EV | | Moisture starting to form on lid | 3 |
| | | 30EVHS1 | | Water droplets forming | 4 |
| | | 25EV | | Water droplets forming | 2 |
| Jun. 7, 2013 | Cooler Temp 4° C. | MDPE/PE | 5 lbs 5.70 oz | Heavy moisture | 6 |
| | | Capran 2500 | 5 lbs 5.20 oz | Very little moisture | 1 |
| | | 75 EVHS1 | 5 lbs 5.20 oz | Heavy moisture under label only | 5 |
| | | 40EV | 5 lbs 5.85 oz | Moisture under label | 4 |
| | | 30EVHS1 | 5 lbs 5.85 oz | Water Droplets on lid | 3 |
| | | 25EV | 5 lbs 5.70 oz | Light moisture under label | 2 |
| Jun. 17, 2013 | Cooler Temp 3° C. | MDPE/PE | 5 lbs 5.60 oz | Heavy mold on one pepper Minor mold on one pepper | 2.10% |
| | | Capran 2500 | 5 lbs 5.20 oz | Very little moisture Still by far the best | 2.20% |
| | | 75 EVHS1 | 5 lbs 5.15 oz | Minor mold starting to form on Stem | 1.70% |
| | | 40EV | 5 lbs 5.70 oz | Mold forming on bruise | 2.00% |
| | | 30EVHS1 | 5 lbs 5.70 oz | Heavy Mold on one Stem minor mold on other | 2.70% |
| | | 25EV | 5 lbs 5.95 oz | Mold starting to form on stems | 2.50% |

TABLE 3-continued

Observations from pepper storage trials.

| Date | Process/ Temp | Label | Weight | Observations | Rating or CO2 Reading |
|---|---|---|---|---|---|
| Jul. 4, 2013 | Cooler Temp 3° C. | MDPE/PE | 5 lbs 5.60 oz | Heavy moisture on lid, One pepper heavy mold and decay, 5 stems with notable mold, peppers cuts crisp | 2.60% |
| | | Capran 2500 | 5 lbs 5.00 oz | Light moisture on lid, very slight mold starting to form on stems, one pepper starting to decay, pepper cuts crisp | 3.10% |
| | | 75 EVHS1 | 5 lbs 5.10 oz | Medium to heavy moisture on lid, Medium to light moisture forming on stems, 2 peppers starting to decay, one pepper heavy decay, mold has formed on bruises, cuts crisp | 2.60% |
| | | 40EV | 5 lbs 5.60 oz | Medium to light moisture on lid, light mold on stems, mold on bruises, 3 peppers starting to decay, peppers cut crisp, 3 peppers look spotted light and dark green in colour | 3.10% |
| | | 30EVHS1 | 5 lbs 5.40 oz | Heavy mold on 4 peppers, 5 peppers heavy decay, Light moisture on lid, peppers cuts crisp | 3.40% |
| | | 25EV | 5 lbs 5.75 oz | Light moisture on lid, Light mold forming on stems, heavy mold around stem base on one pepper, 2 peppers starting to decay, cuts crisp | 3.40% |

The results are further illustrated in photographs of pepper storage over the lifetime of the experiment. These can be seen in FIGS. 1-6.

Example 2

Peppers were packaged as described in example 1. Either Capran 2500 or MDPE/PE films were adhered to the lids covering the openings. Packaged peppers were stored at either room temperature or a lower temperature. Observations from the test are recorded in Table 4.

TABLE 4

Capran 2500 vs. FreshTec at room temperature and refrigerated

| Date | Process | Label Tested | Weight | Observations |
|---|---|---|---|---|
| May 14, 2013 | Room Temp | MDPE/PE | 6 Lbs 2.95 oz | Packing Day, Day 1 Internal temps of Pepper 12 C. |
| | Room Temp | Capran 2500 | 6 Lbs 1.70 oz | |
| | Cooler 10° C. | MDPE/PE | 6 Lbs 1.70 oz | |
| | Cooler 10° C. | Capran 2500 | 6 Lbs 0.90 oz | |
| May 15, 2013 | Room Temp | MDPE/PE | | No visible moisture |
| | Room Temp | Capran 2500 | | No visible moisture |
| | Cooler Temp 8° C. | MDPE/PE | | Start of visible moisture |
| | Cooler Temp 8° C. | Capran 2500 | | No visible moisture |
| May 17, 2013 | Room Temp | MDPE/PE | | No visible moisture |
| | Room Temp | Capran 2500 | | No visible moisture |
| | Cooler Temp 4° C. | MDPE/PE | | Minimal moisture, Warmed up to room temp for 8 hours |
| | Cooler Temp 4° C. | Capran 2500 | | No visible moisture, Warmed up to room temp for 8 hours |

TABLE 4-continued

Capran 2500 vs. FreshTec at room temperature and refrigerated

| Date | Process | Label Tested | Weight | Observations |
|---|---|---|---|---|
| May 21, 2013 | Room Temp | MDPE/PE | | No visible moisture |
| | Room Temp | Capran 2500 | | No visible moisture |
| | Cooler Temp 1° C. | MDPE/PE | | Excessive moisture, Warm up to room temp for 8 hours |
| | Cooler Temp 1° C. | Capran 2500 | | Moisture forming under abel area, Warm up to room temp for 8 hours |
| May 22, 2013 | Room Temp | MDPE/PE | 6 Lbs 2.70 oz | No visible moisture |
| | Room Temp | Capran 2500 | 6 Lbs 1.30 oz | No visible moisture |
| | Cooler Temp 1° C. | MDPE/PE | 6 Lbs 1.65 oz | Water dripping off lid, Warm up to room temp for 8 hours |
| | Cooler Temp 1° C. | 2500 | 6 Lbs 0.85 oz | Moisture really visible now, Warm up to room temp for 8 hours |
| May 23, 2013 | Room Temp | MDPE/PE | | No visible moisture |
| | Room Temp | Capran 2500 | | No visible moisture |
| | Cooler Temp 1° C. | MDPE/PE | | Moisture staying about the same, Warm up to room temp for 8 hours |
| | Cooler Temp 1° C. | Capran 2500 | | Increasing moisture build up, Warm up to room temp for 8 hours |
| May 24, 2013 | Room Temp | MDPE/PE | | No Visible moisture |
| | Room Temp | Capran 2500 | | No Visible moisture |
| | Cooler Temp 1° C. | MDPE/PE | | Warm up to room Temp for 8 hours |
| | Cooler Temp 1° C. | Capran 2500 | | Warm up to room Temp for 8 hours |
| May 27, 2013 | Room Temp | MDPE/PE | 6 Lbs 2.60 oz | Mold on tip of stems and mold starting to form on bottom of box |
| | Room Temp | Capran 2500 | 6 Lbs 1.10 oz | Mold on tip of stems |
| | Cooler Temp 1° C. | MDPE/PE | 6 Lbs 1.65 oz | Moisture on lid and on peppers, Warm to room Temp for 8 hours |
| | Cooler Temp 1° C. | Capran 2500 | 6 Lbs 0.80 oz | Moisture on lid and on peppers but still seem to be less moisture then the FreshTec label, Warm to room Temp for 8 hours |
| Jun. 10, 2013 | Room Temp | MDPE/PE | 6 Lbs 1.80 oz | Extreme mold on stems, on the box and on the pepper themselves, End of this experiment |
| | Room Temp | Capran 2500 | 6 Lbs 0.40 oz | Heavy Mold build up on Stems and start to grow mold on pepper themselves, End of this experiment |
| | Cooler Temp 8° C. | MDPE/PE | 6 Lbs 1.45 oz | Very slight mold growth on tip of stems |
| | Cooler Temp 8° C. | Capran 2500 | 6 Lbs 0.60 oz | Very slight mold growth on tip of stems |
| Jun. 17, 2013 | Cooler Temp 8° C. | MDPE/PE | 6 Lbs 0.50 oz | Mold staying about the same as last week, $CO_2$ 2.3% |
| | Cooler Temp 8° C. | Capran 2500 | 6 Lbs 1.35 oz | Mold staying about the same as last week, $CO_2$ 1.9% |
| Jul. 4, 2013 | Cooler temp 8° C. | MDPE/PE | 6 Lbs 1.15 oz | Heavy water on lid, $CO_2$ 2.8%, Light mold on stems, 6 peppers starting to decay, decay of pepper heavier where carton was touching peppers, pepper still cut crisp |

TABLE 4-continued

Capran 2500 vs. FreshTec at room temperature and refrigerated

| Date | Process | Label Tested | Weight | Observations |
|---|---|---|---|---|
| | Cooler temp 8° C. | Capran 2500 | 5 Lbs 15.95 oz | Excessive Moisture on lids but ½ of FreshTec label box, $CO_2$ 4.5%, 2 peppers heavy decay, heavy mold on stems, Pepper still crisp to cut |
| | Cooler | MDPE/PE | .55 oz | Pitting and start of decay on one pepper, start of slight dehydration |
| | Cooler | Capran 2500 | .95 oz | Pitting on one pepper, one pepper with heavy decay where it was touching paper, the other pepper is soft to touch |
| | Room Temp | MDPE/PE | 1.15 oz | |
| | Room Temp | Capran 2500 | 1.30 oz | |

Example 3

Cherries and peppers were packaged as described in Example 1. Only Capran 2500 film was adhered the lids to cover the openings in the lids. In some pepper packages, sachets containing oxidizing compounds (sodium chlorite, citric acid and an inert carrier) were placed in the containers to mitigate growth of microbes and spoilage of the peppers or cherries. Time-lapse observations are provided in Table 5.

TABLE 5

Observations of packaged cherries and peppers.

| Date | Process | Label Tested | Weight | Observations |
|---|---|---|---|---|
| Jul. 4, 2013 | Cooler Temp 3° C. | Cherries with reg lid Capran 2500 no Sachet | 9 lbs 4.25 oz | Brix on Cherries 16 (test with 10 cherries) Internal Temp 11.5° C. |
| | | Cherries with all but 4 holes covered Capran 2500 no sachet | 9 lbs 4.50 oz | Cherries where Dumped in water for a second and put into box wet |
| | | Peppers with Reg lid Capran2500 5 g Sachet | 6 lbs | Pepper internal Temp was 12.5° C. |
| | | Peppers with all but 4 holes covered Capran 2500 5 g sachet | 5 lbs 11.20 oz | |
| | | Peppers reg lid Capran 2500 no sachet | 5 lbs 11.95 oz | |
| | | Peppers with all but 4 holes covered Capran 2500 no Sachet | 5 lbs 11.50 oz | |
| Jul. 8, 2013 | Cooler Temp 3° C. | Cherries with reg lid Capran 2500 no Sachet | | Light moisture on lid and under label $CO_2$ 4.6% |
| | | Cherries with all but 4 holes covered Capran 2500 no sachet | | Very light moisture around taped areas to cover holes $CO_2$ 6.1 |
| | | Peppers with Reg lid Capran 2500 5 g Sachet | | Stems have being bleached from sachet, heavier right under sachet but still bleaching of stem near outside of box, $CO_2$ 2.2% |

TABLE 5-continued

Observations of packaged cherries and peppers.

| Date | Process | Label Tested | Weight | Observations |
|---|---|---|---|---|
| | | Peppers with all but 4 holes covered Capran 2500 5 g sachet | | No visible moisture, No notable bleaching of stems $CO_2$ 2.1% |
| | | Peppers reg lid Capran 2500 no sachet | | No visible moisture $CO_2$ 1.5% |
| | | Peppers with all but 4 holes covered Capran 2500 no Sachet | | Moisture around taped areas $CO_2$ 1.6% |
| Jul. 11, 2013 | Cooler Temp 3° C. | Cherries with 2500 no Sachet | | No changes since July 8 reg lid Capran |
| | | Cherries with all but 4 holes covered Capran 2500 no sachet | | No changes since July 8 |
| | | Peppers with Reg lid Capran 2500 5 g Sachet | | No changes since July 8 |
| | | Peppers with all but 4 holes covered Capran 2500 5 g sachet | | No changes since July 8 |
| | | Peppers reg lid Capran 2500 no sachet | | No changes since July 8 moved to 8° C. cooler |
| | | Peppers with all but 4 holes covered Capran 2500 no Sachet | | No changes since July 8 moved to 8° C. cooler |
| | | | | Brix on cherries 16.5 (test 10 cherries) |
| Aug 9, 2013 | Cooler Temp 3° C. | Cherries with reg lid Capran 2500 no Sachet | 9 lbs 3.80 oz | $CO_2$ 6.4% Stems still green, minor mold on 5-6 cherries |
| | | Cherries with all but 4 holes covered Capran 2500 no sachet | 9 lbs 4.05 oz | $CO_2$ 11.7% Heavy moisture on lid, green stems mold on 2-3 cherries |
| | | Peppers with Reg lid Capran 2500 5 g Sachet | 5 lbs 15.90 oz | $CO_2$ 2.3% Very little moisture, heavy bleaching of stems, stems starting to dry out |
| | | Peppers with all but 4 holes covered Capran 2500 5 g sachet | 5 lbs 11.25 oz | $CO_2$ 3.0% No moisture on lid, slight bleaching on stems, 1 pepper minor decay |
| | Cooler Temp 8 C. | Peppers reg lid Capran 2500 no sachet | 5 lbs 12.05 oz | $CO_2$ 5.4% Heavy moisture on lid, mold forming on tips of stems |
| | | Peppers with all but 4 holes covered Capran 2500 no Sachet | 5 lbs 11.20 oz | $CO_2$ 6.8% Heavy moisture on lid |

Other variations and modifications of the invention are possible. All such modifications or variations are believed to be within the sphere and scope of the invention as defined by the claims appended hereto.

We claim:

1. A system for mitigating spoilage of perishable produce, the system comprising:

a container defining a compartment for storage of perishable produce;

a lid for the container, the lid comprising a recessed surface relative to a raised surface of the rest of the lid, the recessed surface defining a plurality of perforations in the recessed surface; and a label comprising a polyamide film and a hydrophilic ink, the polyamide film comprising:

an oxygen transfer rate of 20-1245 $cm^3/m^2$/day atm at 25° C. and 0% relative humidity, a carbon dioxide permeability of 60-100 $cm^3/m^2$/day atm at 25° C. and 0% relative humidity, a water vapor transmission rate of between 170 and 470 g $m^2$/day at 38° C. and 0% relative humidity, wherein the polyamide film sealed to the raised surface of the lid and covering the recessed surface of the lid to form a space between the polyamide film and the recessed surface a sachet positioned in the space between the recessed surface of the lid and the polyamide film, the sachet containing an oxidizing compound.

2. The system of claim 1, wherein the film is transparent.

3. The system of claim 1, wherein the film has a thickness of 500-10,000 μm.

4. The system of claim 1, wherein the film has a surface area of 90-500 $cm^2$.

5. The system of claim 1, wherein the container is formed from a rigid material formed to maintain shape when carrying perishable produce.

6. The system of in claim 1, wherein the film is comprised of mixtures of nylon with other polymeric and non-polymeric components.

7. The system of claim 6, wherein the film is comprised of one or more of nylon-6, nylon-66, nylon-6/66 or nylon-6/12.

8. The system of claim 1, wherein the oxidizing compound comprises sodium chlorite, citric acid and an inert carrier.

9. A system for mitigating spoilage of perishable produce, the system comprising:

a container defining a compartment for storage of perishable produce and/or flowers and having a first opening;

a lid attached to the first opening, the lid defining a recessed surface therein and defining a second opening further defined by a plurality of perforations in the recessed surface in communication with the compartment;

a label comprising a polyamide film and a hydrophilic ink, the polyamide film comprising:

an oxygen transfer rate of 20-36 $cm^3/m^2$/day atm at 25° C. and 0% relative humidity, a carbon dioxide permeability of 60-100 $cm^3/m^2$/day atm at 25° C. and 0% relative humidity, a water vapor transmission rate of between 170 and 470 g $m^2$/day at 38° C. and 0% relative humidity, wherein the polyamide film is sealed to the lid and covering the recessed surface to form a space between the polyamide film and the second opening, and a sachet positioned in the space between the recessed surface of the lid and the polyamide film, the sachet containing an oxidizing compound.

10. The system of claim 9, wherein the hydrophilic ink forms a graphic and and/or identifying information.

11. The system of claim 9, wherein the water vapor transfer rate of the film increases with an increase in temperature.

12. The system of claim 9, wherein the lid comprises a recessed surface relative to a surrounding raised surface of the lid, the second opening being defined by the recessed surface and wherein the film is attached to the raised surface of the lid to cover and seal a space defined by the recessed surface and walls between the raised surface and the recessed surface.

13. The system of claim 12, wherein the recessed surface defines a plurality of perforations.

14. The system of claim 9, wherein the film seals within the compartment antimicrobial vapors from the sachet.

15. The system of claim 9, wherein the oxidizing compound comprises sodium chlorite, citric acid and an inert carrier.

* * * * *